US008455745B2

(12) United States Patent
Dusin et al.

(10) Patent No.: US 8,455,745 B2
(45) Date of Patent: Jun. 4, 2013

(54) MUSICAL INSTRUMENT AND METHOD OF FORMING A SURFACE THEREOF

(75) Inventors: James W. Dusin, Farmington, MO (US); Kyle C. Cox, Farmington, MO (US)

(73) Assignee: Pantheon Steel, LLC, Farmington, MO (US)

( * ) Notice: Subject to any disclaimer, the term of this patent is extended or adjusted under 35 U.S.C. 154(b) by 238 days.

(21) Appl. No.: 12/883,981

(22) Filed: Sep. 16, 2010

(65) Prior Publication Data

US 2011/0061513 A1 Mar. 17, 2011

Related U.S. Application Data

(60) Provisional application No. 61/243,362, filed on Sep. 17, 2009.

(51) Int. Cl.
*G10D 13/02* (2006.01)

(52) U.S. Cl.
USPC ..... 84/411 R

(58) Field of Classification Search
USPC ..... 84/411 R, 421, 420; 446/188, 418
See application file for complete search history.

(56) References Cited

PUBLICATIONS

Kronman, Ulf; Steel Pan Tuning Handbook: A Handbook for Steel Pan Making and Tuning; Jan. 1992; Section II Developments, Innovations and Experiments.*

* cited by examiner

*Primary Examiner* — Kimberly Lockett
(74) *Attorney, Agent, or Firm* — Matthew A. Pequignot; Pequignot + Myers LLC

(57) ABSTRACT

A musical instrument and method of making the surface of a musical instrument for use as a pan drum includes providing a sheet of metal, securing an outer peripheral region of the sheet of metal such that it is mechanically clamped or held and bringing an the inner region of the sheet of metal and a forming member together in such a manner as to provide a force therebetween while relatively rotating the sheet and the forming member so as to form a bowl which is used as an upper or lower surface of a drum. A thickness of the hemisphere of the bowl varies radially from the outside edge to the central axis such that a region therebetween has a thickness that is at least 30% less than a thickness of the outside edge or a thickness about the central axis.

20 Claims, 4 Drawing Sheets

MUSICAL INSTRUMENT AND METHOD OF FORMING A SURFACE THEREOF

CROSS-REFERENCE TO RELATED APPLICATIONS

The present invention claims priority from U.S. Provisional Patent Application No. 61/243,362 filed Sep. 17, 2009, which is incorporated herein by reference.

FIELD OF THE INVENTION

This invention relates generally to forming the surface of a drum, such as, for example a pan steel drum (steel pan) or hand played steel drum (hand pan).

BACKGROUND OF THE INVENTION

Heretofore, fabricating a steel drum has been a laborious hit-and-miss process, which requires great skill and often days of labor to produce the pan, upper surface of the drum.

To form the pan surface a 55-gallon oil drum having a preferred quality of its steel is pounded upon its bottom end with hand or air hammers, stretching the metal into a concave bowl or dish shape. This process is known as "sinking the pan". Care must be taken to stretch the metal evenly without deforming the rim or tearing the metal on the pan surface being formed. This process can take many hours. One advantage to forming the pan in this manner is that the hammering and working of the metal hardens it, which helps improve the timbre of the drum later on during the tuning process.

A template is used to mark the placement of each note on the sunken head of the drum. The note outlines and areas between the notes are subsequently hammered using a hand or air hammer, making the notes more visible and more importantly substantially isolating each note's vibration from the other notes in the drum. Notwithstanding, care must be taken so as to not to weaken or misform the metal during this process.

After shaping the notes an assortment of hammers are used to 'bubble' the notes up from beneath, which yields raised distinct surfaces on the upper side of the pan, resulting in a release of tension to prepare the notes to be hammered from the topside to align the correct pitches. Each note is effectively a steel membrane which can be played, and the finished product is numerous membranes within a drum, or more accurately numerous notes within a drum having its own fundamental, octave and harmonic pitch.

After shaping and bubbling the notes, the steel is tempered by heating and cooling the metal to increase the resilience and strength of the metal, which prepares the metal for the tuning process.

Using a stroboscope or other tuning instrument the maker hammers with a skill possessed by few, stretching and smoothing the note area so that it will vibrate precisely. Each individual note on the drumhead must be tuned in relation to the other notes, or the pan will not resonate correctly. Often a panmaker will tune each note several times before the whole pan is fully in tune.

Hand steel drums are similar to pan drums in many respects, however the upper surface of a 'handpan' is convex rather than concave. Thus, the bowl, which is played, is upside down so that the player plays upon a mound rather than a depression. In many ways, the handpan is much more of a precision hand percussion instrument than its predecessor the steel pan. Each note is tuned along two orthogonal axes; the first long axis produces a desired note and its octave and the other shorter axis produces that note's harmonics. Both the top and bottom surface of the handpan are bowls and is sometimes referred to as looking like a flying saucer. The top surface of the handpan has a central bass note 400 surrounded by seven or eight tonal notes 402 as is shown in FIG. 4. In a new and preferred process we have developed we use a flat die to stamp each of the tonal notes before fine tuning them through a hammering process. This stamping process provides a significant "head-start" in the tuning process. The stamping provides a planar note surface 404 and offers significant uniformity within the drums we manufacture.

One significant difference between the playing surface of a handpan drum and the pan drum, is that the handpan heretofore has been formed by stamping the metal into the required bowl or hemisphere-like shape of substantially uniform thickness, including the central bass note at the top. Although this stamping process saves a significant amount of time to produce the required spherical surface including the central bass note, we have found that the tonal quality is compromised by stamping the sheet metal. Stamping produces a hemispherical-like surface having a substantially uniform thickness across the radius of the bowl, which we believe is not preferred for all tonal fields that will reside in a mid-band region or especially the central dome note. Furthermore, stamping does not harden the metal in the same manner as hammering.

It is an objective of this invention to overcome these limitations.

This invention provides a method, which produces a drumming surface, which overcomes some of the limitations of stamping, and which does not require as many hours of hammering required to produce a traditional steel drum. Furthermore, the method produces a reproducibility and consistency not found in traditional hammering methods.

Furthermore, by stretching the metal non-uniformly and providing a varying surface thickness, so that a central region of the dome or bowl forming a ring between the central axis and the outer periphery is thinner than regions on either side of the ring, a drum surface for locating notes is provided with thickness and hardness yielding a playing surface that produces rich, vibrant, resilient and strong tones.

SUMMARY OF THE INVENTION

In accordance with the invention there is provided a method of making a surface of a musical instrument for use as a drum comprising:

providing a sheet of metal having an outer peripheral region and an inner region which will form the drum;

securing the outer peripheral region of the sheet of metal such that it is mechanically clamped or held;

relatively bringing an the inner region of the sheet of metal and a forming member together in such a manner as to provide a force therebetween that is sufficient to form the inner region of the sheet into a bowl shape while relatively rotating the sheet and the forming member.

In accordance with another aspect of the invention there is provided drum surface for generating one or more audible tones comprising:

a curved substantially hemispherical metal surface having a central axis of symmetry, the surface forming a dish on an inside surface and forming a dome on an outside surface thereof, a thickness of the surface varying radially from the outside edge to the central axis such that a region forming a ring having a width therebetween has a thickness that is at least 15% less and preferably at least 30% less than a thickness of the outside edge or a thickness about the central axis.

BRIEF DESCRIPTION OF THE DRAWINGS

Exemplary embodiments of the invention will now be provided in which.

DETAILED DESCRIPTION

Figure 1:
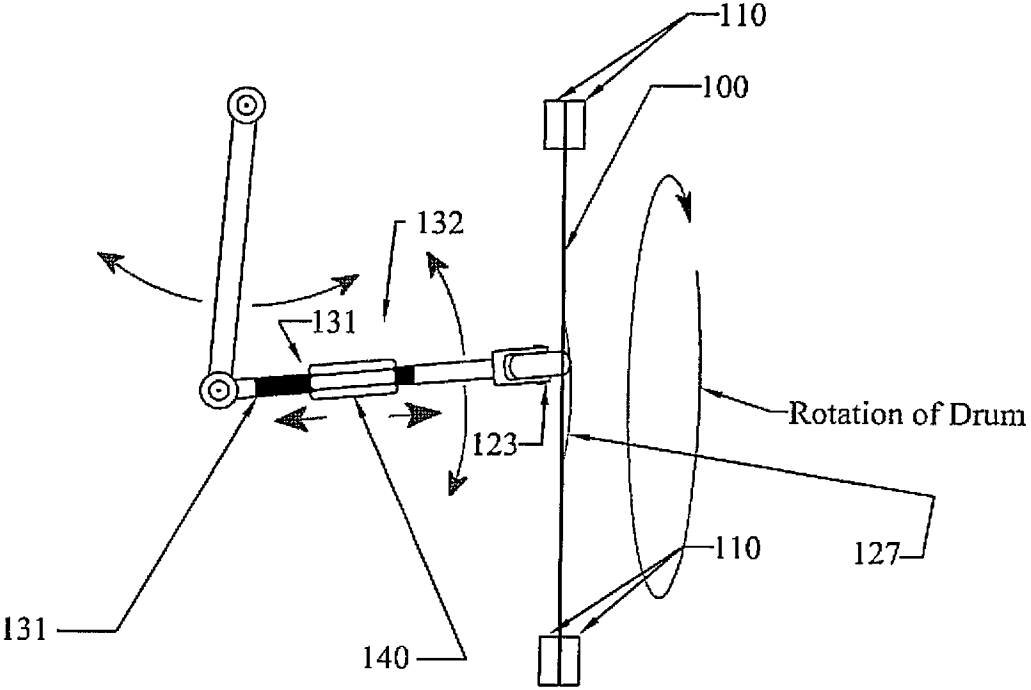
FIG. 1 is a side view of a machine for forming a surface of a drum wherein a sheet of steel to be formed is rotatably held while an arm having a wheel forms the sheet of steel.

Referring now to FIG. 1, a side view of a device for rolling sheet steel into a bowl-like structure is shown. For ease of understanding the motor, gears and rotating drum are not shown. A drum plate in the form of flat plate of sheet steel 100 having a diameter of approximately 26 inches is shown securely held by way of being clamped between two frame members 110 along outer edges thereof. Although the clamped sheet of steel is fixed by of being clamped so that it cannot move in a direction lateral to its faces, it is mechanically rotated about a central axis orthogonal to the plane of sheet. As the sheet is rotated at a speed of approximately 45 revolutions per minute, a roller 123 makes contact with the sheet steel 100 forcing it to be dished. A line 127 labeled "roll passes" shows a small arc sweep of the extendable arm 132 at it begins to dish the sheet of steel 100. The mechanism for forcing the roller wheel against the sheet of steel 100 is comprised of an arm having sections 120 and 131 which can be controllably pivoted about a fixed pivot point A and which is pivotally connected to the extendible arm 132 via pivot point B, which is controllably movable by varying the radius of the arm 132 via radius adjustment 140. The roller 123 position is controlled by a suitably programmed computer and is changed so that the origin of the arc sweep by the roller arm varies in time. The arm 131 and extendable arm 132 are hydraulically controlled by the computer. Arm 131 is shown at 5 degrees from vertical.

Figure 2:
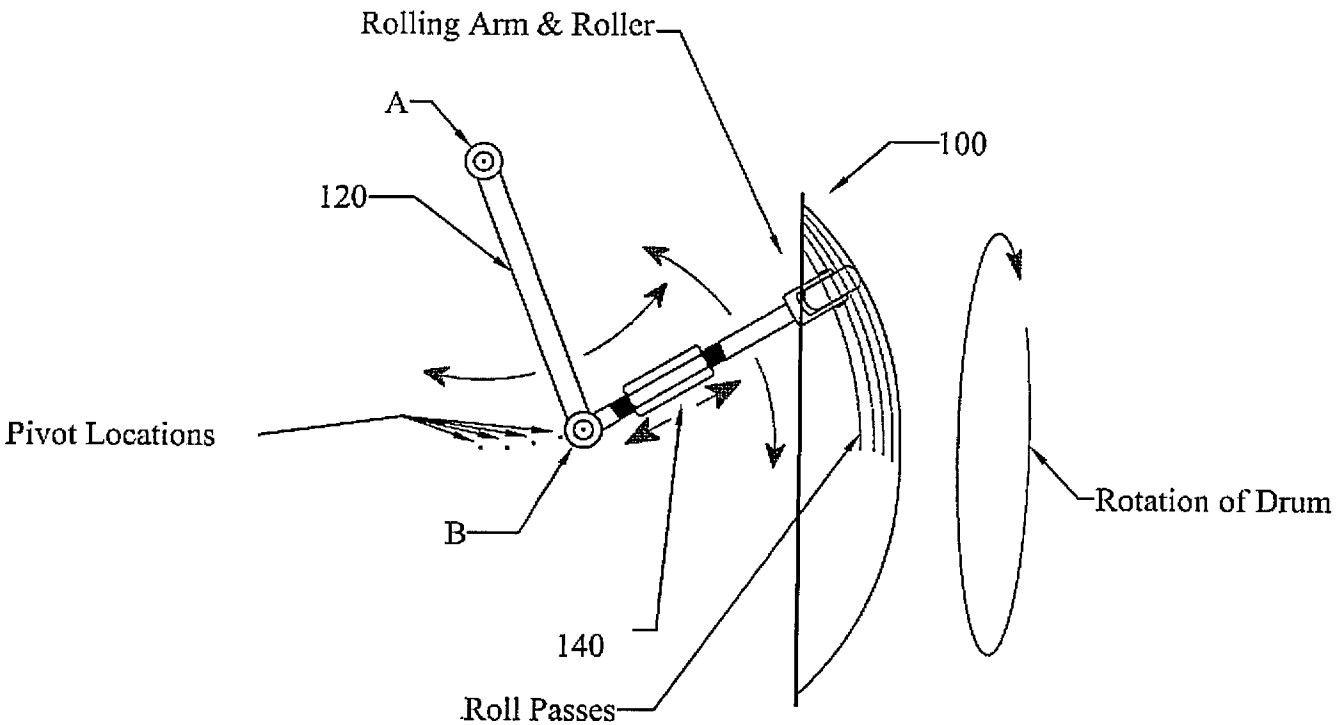
FIG. 2 is a is another view of the machine wherein positions of the force arm are shown to follow a path that provides more tension in desired regions of the sheet as it is formed into a bowl and whereby the arms sweeps through different arc paths with subsequent passes.
Figure 3:
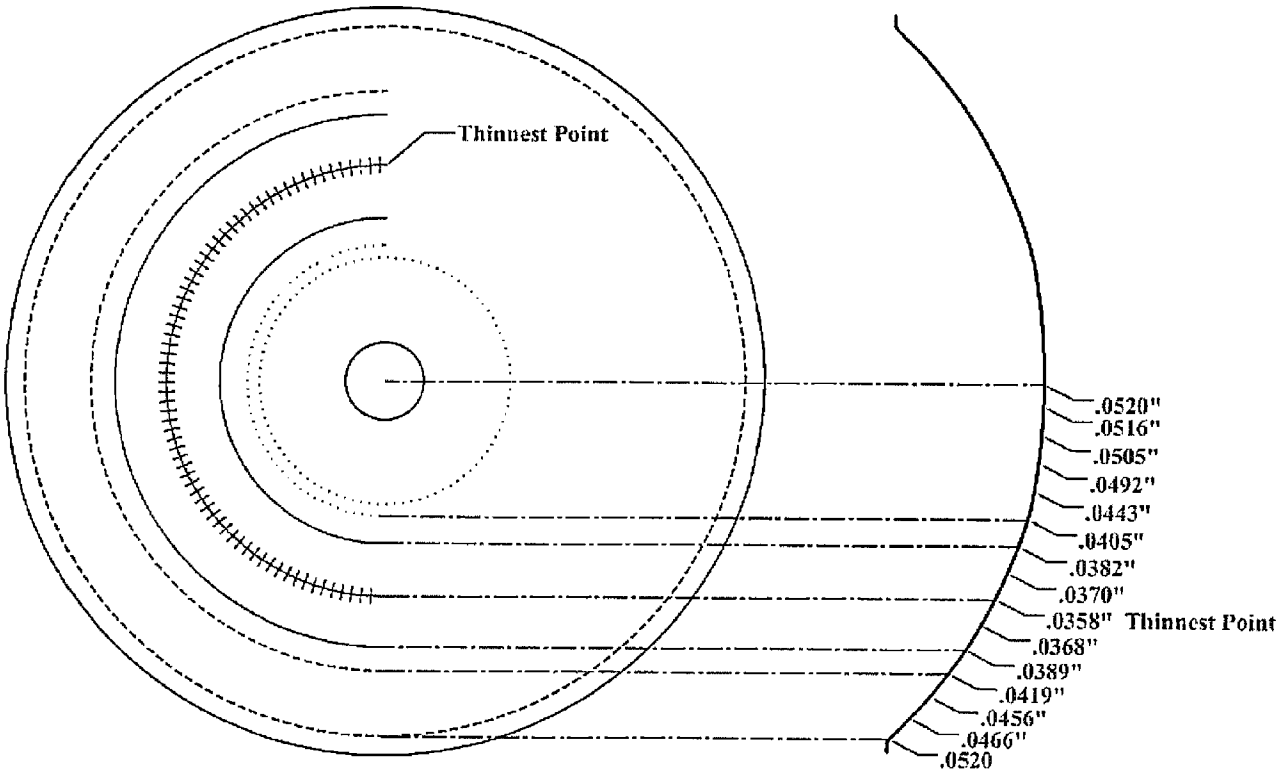
FIG. 3 is a diagram illustrating the variation in thickness of the drum surface.

FIG. 2 shows the same device of FIG. 1 wherein the extendable arm 132 is shortened and wherein the pivot point B is advanced four steps closer to the origin of where the sheet of steel was before rolling it. By advancing the pivot point B and moving along an upward trajectory the metal is worked and stretched non-uniformly so that the metal in a band between the centre axis of the bowl and the outer rim becomes thinner. Thus with subsequent passes the arc orientation varies. The benefit of this variation in orientation of arcs such that a different non-parallel path is followed, is that the metal with a region between the central axis of the sheet and the outer periphery is worked and stretched by the rolling of the sheet so that it becomes thinner in this central band than regions to either side. As a result the metal in a region about the central axis of the sheet and about the periphery of the sheet is at least 1.4 times thicker than it is in the mid band region where the notes will be located. This is shown in FIG. 3 wherein at its thickest the steel is 0.052 inches and at its thinnest it is 0.0358 inches along a central region or band labeled "thinnest point". In a lateral direction from the center to the outer periphery a point lying on this band would be a thinnest point.

In a preferred embodiment of the invention a roller is controllably forced into the sheet of steel, however other force members can be used. Alternatively while forcing the roller or force member, this member can be vibrated or reciprocated minimally so as to provide a percussive force to the sheet of steel. It is preferred that the steel be rolled in the absence of a mandrel. Preferably the roller moves from the outside periphery inward but does not pass the center of the bowl. This ensures that the metal at the centre is not stretched too thin as the center of the bowl will form the largest note having the deepest pitch, and, it is preferable that the metal be thicker in this region than in the central band where the other notes will be formed.

Although adding to the complexity of the device the arm 132 can be controlled so as to extend and contract rapidly providing a simultaneous percussive or hammering effect while rolling. This would add to the hardness of the metal.

Figure 4:
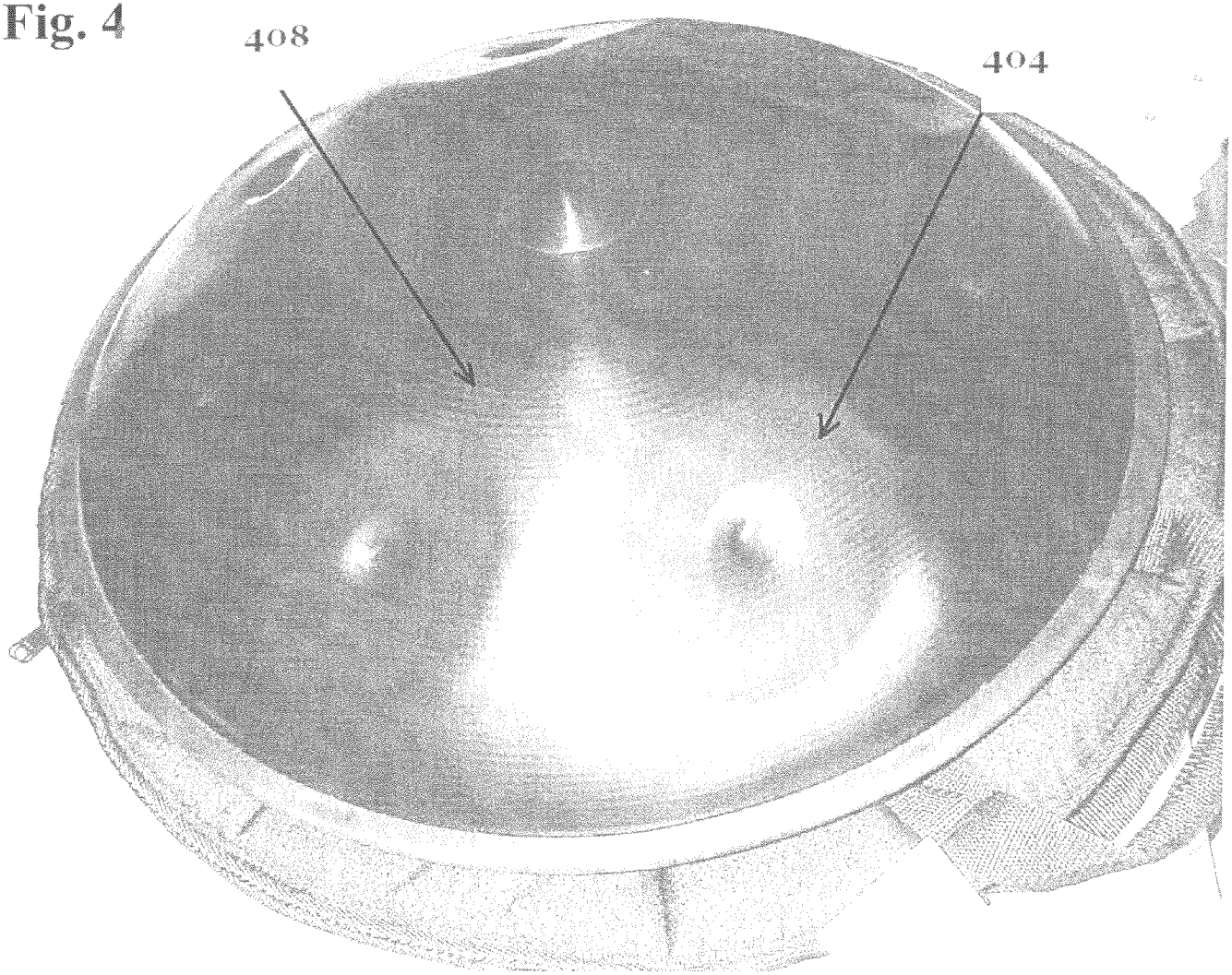
FIG. 4 is a photograph of a drum in accordance with this invention.

Although the arrangement shown has the dish fixed and rotating while the arm 132 moves into the dish, alternatively but less preferably, the dish may be controlled so as to move into a fixed arm wheel arrangement. Relative movement between the two is required. The arrangement shown is preferably as it is easier to move and control the arm and wheel than it is to move the drum. After forming the dish or drumming surface by rolling as described above, small grooves or rings 408 as shown in FIG. 4 are formed in the dish which appear as grooves similar to tonal grooves or rings in a cymbal which are purposefully formed to enhance the cymbal's sound. We believed that these grooves serendipitously formed by our process enhance the sound of our drum.

In the embodiment shown in FIG. 4, notes are shown substantially centered on substantially planar surfaces 404 along a surface of the drum. After forming the dish as described with reference to FIGS. 1 through 3, the flat surfaces 404 each having a dimple are formed stamping followed by hammering to better tune and harden these surfaces. The region where the flat surfaces 404 are located is the region where the metal of the dish is the thinnest, which provides a rich lasting tone when the notes are played.

Numerous other embodiments may be envisaged, without departing from the spirit and scope of the invention.

What is claimed is:

1. A method of making a surface of a musical instrument for use as a pan drum comprising:

a) providing a sheet of metal having an outer peripheral region and an inner region which will form the drum;

b) securing the outer peripheral region of the sheet of metal such that it is mechanically clamped or held;

c) relatively bringing an the inner region of the sheet of metal and a forming member together in such a manner as to provide a force therebetween while relatively rotating the sheet and the forming member so as to form a first bowl, wherein step (c) is performed by a computer controlled machine.

2. A method as defined in claim 1 wherein the forming member is a roller and wherein grooves are formed in the inner region by the forming member, and wherein the roller is applied in the absence of a mandrel.

3. A method as defined in claim 1, wherein the computer controlled machine includes the forming member, and wherein the forming member is brought into contact with the inner region of the metal sheet and is forced against the inner region of the metal sheet with a force sufficient to deform the metal sheet.

4. A method as defined in claim 3 wherein the force changes non-linearly as the member moves across the inner region of the sheet.

5. A method of making a surface of a musical instrument for use as a pan drum comprising:

d) providing a sheet of metal having an outer peripheral region and an inner region which will form the drum;

e) securing the outer peripheral region of the sheet of metal such that it is mechanically clamped or held;

f) relatively bringing the inner region of the sheet of metal and a forming member together in such a manner as to provide a force therebetween while relatively rotating the sheet and the forming member so as to form a bowl, wherein the forming member is a roller and wherein grooves are formed in the inner region by the forming member, and wherein the roller is applied in the absence of a mandrel.

6. A method as defined in claim 5 wherein the forming member is moved across the inner region of the metal sheet without passing beyond the center of the sheet, thereby sweeping through an arc of no more than 90 degrees.

7. A method as defined in claim 5 wherein the grooves form circular patterns in the inner region.

8. A method as defined in claim 7 wherein the step of securing the sheet includes the step of securing the outer peripheral region of the sheet in a frame clamped between two members.

9. A method as defined in claim 8 wherein the step of securing the sheet includes bolting the outer peripheral region to a frame.

10. A method as defined in claim 9 wherein the outer peripheral region is clamped while being rotated about an axis orthogonal to an axis about which the forming member is moved.

11. A method as defined in claim 10, wherein the first bowl is stamped with domes or dimples to form note regions.

12. A method as defined in claim 11 wherein the note regions have substantially planar surfaces defined about the domes or dimples each forming drumming region forming a musical note, and wherein a plurality of the notes differ in pitch.

13. A method as defined in claim 12 further comprising providing a second bowl having an opening in a bottom portion thereof, wherein the second bowl is coupled to the first bowl forming an instrument.

14. A musical instrument for drumming comprising:

an upper curved substantially hemispherical metal surface having a central axis of symmetry, the hemisphere forming a dish on an inside surface and forming a dome on an outside surface thereof, a thickness of the hemisphere varying radially from the outside edge to the central axis such that a region therebetween has a thickness that is at least 30% less than a thickness of the outside edge or a thickness about the central axis.

15. A musical instrument as defined in claim 14 wherein the thickness of the metal in a region immediately surrounding the central axis is at least 1.4 times the thickness of a mid region of the hemisphere.

16. A musical instrument as defined in claim 14 wherein the upper curved substantially hemispherical surface has a plurality of spaced apart note regions located on the surface, wherein a major portion of each note region is substantially planar.

17. A musical instrument as defined in claim 16 wherein a minor portion of each note region is concave or convex in a central region of the note region.

18. A musical instrument as defined in claim 17, wherein the major portion of each note region is stamped so as to form the planar surface.

19. A musical instrument as defined in claim 14 further comprising a bowl shaped bottom coupled to the upper curved substantially hemispherical metal surface.

20. A musical instrument as defined in claim 14 wherein the thickness of the metal around an outer periphery of the hemisphere is at least 1.4 times the thickness of a mid region of the hemisphere.

* * * * *